US006409233B1

(12) United States Patent
Hanaki

(10) Patent No.: US 6,409,233 B1
(45) Date of Patent: Jun. 25, 2002

(54) CLOSURE APPARATUS FOR VEHICLE DOOR

(75) Inventor: Naoki Hanaki, Yokohama (JP)

(73) Assignee: Ohi Seisakusho Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/596,582

(22) Filed: Jun. 19, 2000

(30) Foreign Application Priority Data

Jun. 18, 1999 (JP) ..... 11-173357

(51) Int. Cl.[7] ..... E05C 1/06
(52) U.S. Cl. ..... 292/144; 292/201; 292/DIG. 23
(58) Field of Search ..... 292/138, 139, 292/144, 195, 201, 216, DIG. 23, DIG. 45, DIG. 65, 336.3

(56) References Cited

U.S. PATENT DOCUMENTS

| | | | | |
|---|---|---|---|---|
| 4,823,059 A | | 4/1989 | Compeau | |
| 4,843,849 A | | 7/1989 | Kamke | |
| 4,988,135 A | * | 1/1991 | Ottino | 292/201 |
| 5,618,068 A | * | 4/1997 | Mitsui et al. | 292/201 |
| 5,802,894 A | * | 9/1998 | Jahrsetz et al. | 292/201 |
| 6,131,337 A | * | 10/2000 | Machida | 292/201 |

FOREIGN PATENT DOCUMENTS

| | | |
|---|---|---|
| DE | 33 33 746 | 6/1985 |
| DE | 35 31 931 | 3/1987 |
| DE | 39 00 509 | 8/1989 |
| JP | 11-256903 A * | 9/1999 |

* cited by examiner

*Primary Examiner*—Paul N. Dickson
*Assistant Examiner*—Thomas J. Williams
(74) *Attorney, Agent, or Firm*—Kilpatrick Stockton LLP

(57) ABSTRACT

A door closure apparatus has a striker disposed on one of a periphery of a door or a door opening of a door, and a lock apparatus disposed on the other of the periphery of a door and periphery of a door opening, wherein the motive force of a drive motor forcibly causes movement of a driven member that is one of the striker and the lock apparatus, so as to completely close a door that was in a half-latched condition, this door closure apparatus having a main actuation member, a stopper member, a position detector, and a controller with a motor controller. The main actuation member can move between a waiting position and an actuation position, the position thereof being detected by sensing an electrical value of the drive motor. A motor controller stops the motor drive when a prescribed rime has elapsed.

4 Claims, 14 Drawing Sheets

HL(WAITING)

HL(FORWARD)

FL(REV. START)

FL(WAITING)

(OP)

(HL)

(BEFORE FL)-1

(BEFORE FL)-2

(FL TO OST)

CLOSURE APPARATUS FOR VEHICLE DOOR

BACKGROUND OF THE INVENTION

1. Field of the Invention

The present invention relates to a closure apparatus for a vehicle door, in which a striker is disposed on one of a periphery of a door and a periphery of an opening for the door, a lock apparatus removably engageable with the striker is disposed on the other of the periphery of the door and the periphery of the opening for the door, and a driven member of one of the striker and the lock apparatus is forcibly moved by a drive motor, so that the door in a half-close condition is closed completely.

2. Description of the Related Art

In the past, a known closure apparatus for a vehicle door was as disclosed, for example, in the Japanese Patent Application Laid-Open Publication No. 10-184144.

Specifically, according to the technology disclosed therein, a main actuation member that is the main part of a door closing mechanism linked to a door closing drive motor is provided with a neutral switch for detecting an initial position (a waiting position) from which the closing of the door begins or, rather than providing this neutral switch, the main actuation member is caused to come into contact with a stopper member at the initial position, thereby preventing movement, the neutral position being detected based on a drive condition (a load current or rotational condition) of the drive motor continuing to rotate.

In this prior art, however, when a neutral switch is provided within the apparatus so as to detect the initial position (the waiting position), there is an increase in the number of parts, the apparatus becomes large, and the cost increases. In the approach of detecting the initial position based on a drive condition of the drive motor, at the initial position the main actuation member is stopped in a condition pressing the stopper member, having mutual loads acting on the main actuation member and the stopper member, with an excessive load imposed on the drive motor, constituting a hindrance against improvements in durability of the main actuation member, the stopper, and the drive motor.

SUMMARY OF THE INVENTION

The present invention has been made with such points in view. It therefor is an object of the present invention to provide a closure apparatus for a vehicle door, permitting the number of component parts to be decreased and the scale of apparatus to be compact, with a reduced cost.

An aspect of the present invention to achieve the object is a closure apparatus for a vehicle door, comprising a stationary first locking element, a rotatable second locking element engaeable with the first locking element to lock the vehicle door, a link motion operatively connectable to and disconnectable from the second locking element, a drive motor operatively connected to the link motion, and a controller responsible for a motor current of the drive motor to control the drive motor to establish operative connection between the link motion and the second locking element.

According to this aspect of the invention, the link motion may have a voluntary link position disconnected from the second locking element, but the controller permits the motor to be operatively connected to the second locking element, so that the second locking element can be driven for a door locking operation, without the need of a limit switch to detect a link position of the link motion responsible for an established connection to the second locking element.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

FIG. 1 to FIG. 14 illustrate a disclosure apparatus according to an embodiment of the present invention.

Figure 1:
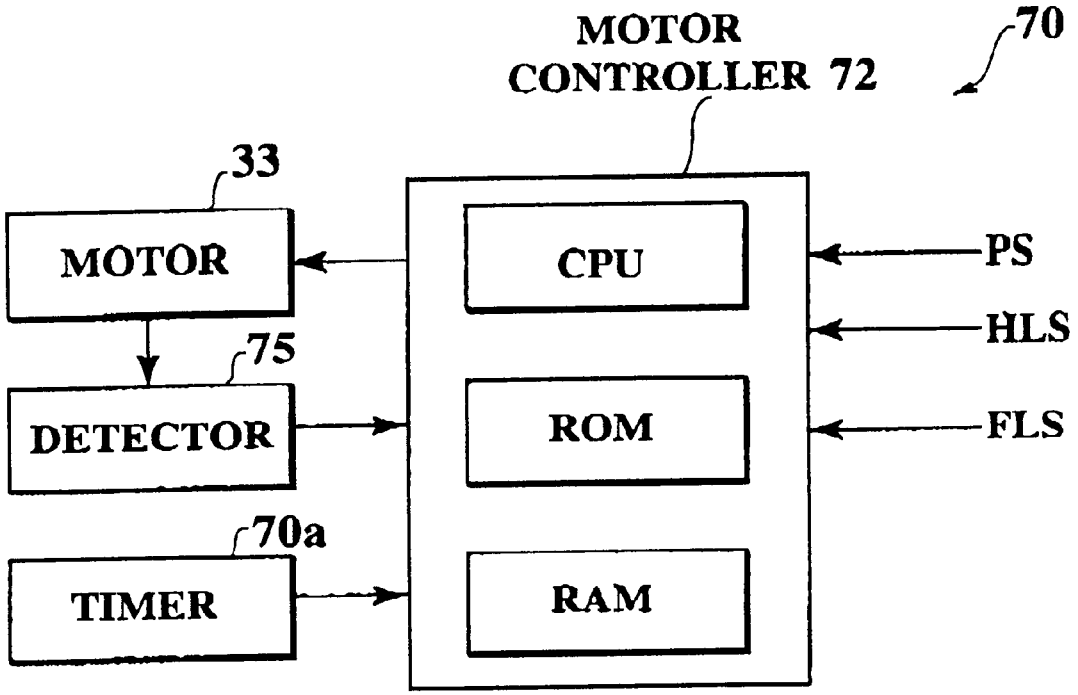
FIG. 1 is a functional block diagram of a vehicle door closure apparatus according to an embodiment of the present invention.

As schematically shown in FIG. 1, the disclosure apparatus has a controller 70 including a motor controller 72 constituted with a CPU (central processing unit) and peripherals therefor, such as a ROM (read-only memory), a RAM (random access memory), etc, and a timer 70*a* connected thereto. A drive motor 33 and an electrical value detector 75 connected thereto are electrically interfaced with the motor controller 72.

Figure 2:
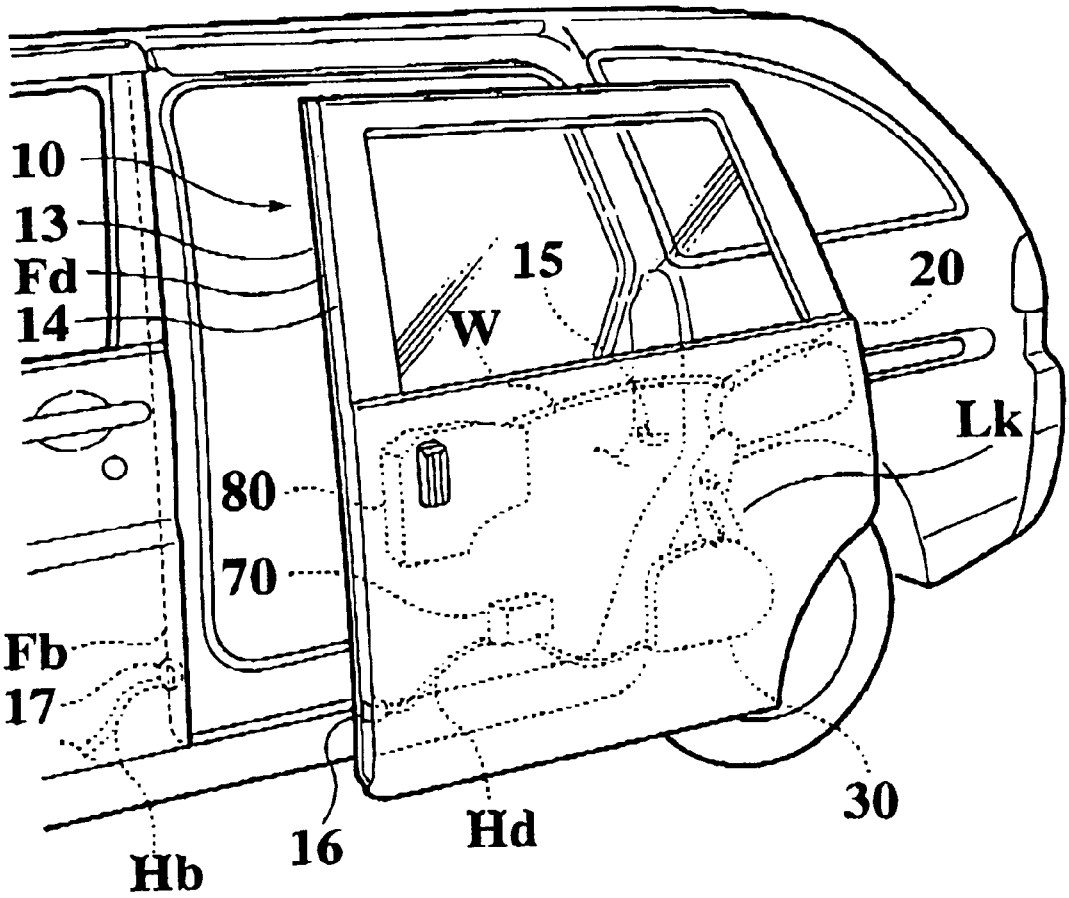
FIG. 2 is a drawing showing the mounting condition of the door closure apparatus of FIG. 1.

As shown in FIG. 2, the disclosure apparatus is provided for disclosure of a vehicle with a sliding door 10. The sliding door 10 is guided by such elements as a sliding roller and guide rail, in the initial condition when opened is pulled at an angle rearward with respect to the side of the vehicle, after which it can be slid rearward in parallel with the vehicle.

Figure 3:
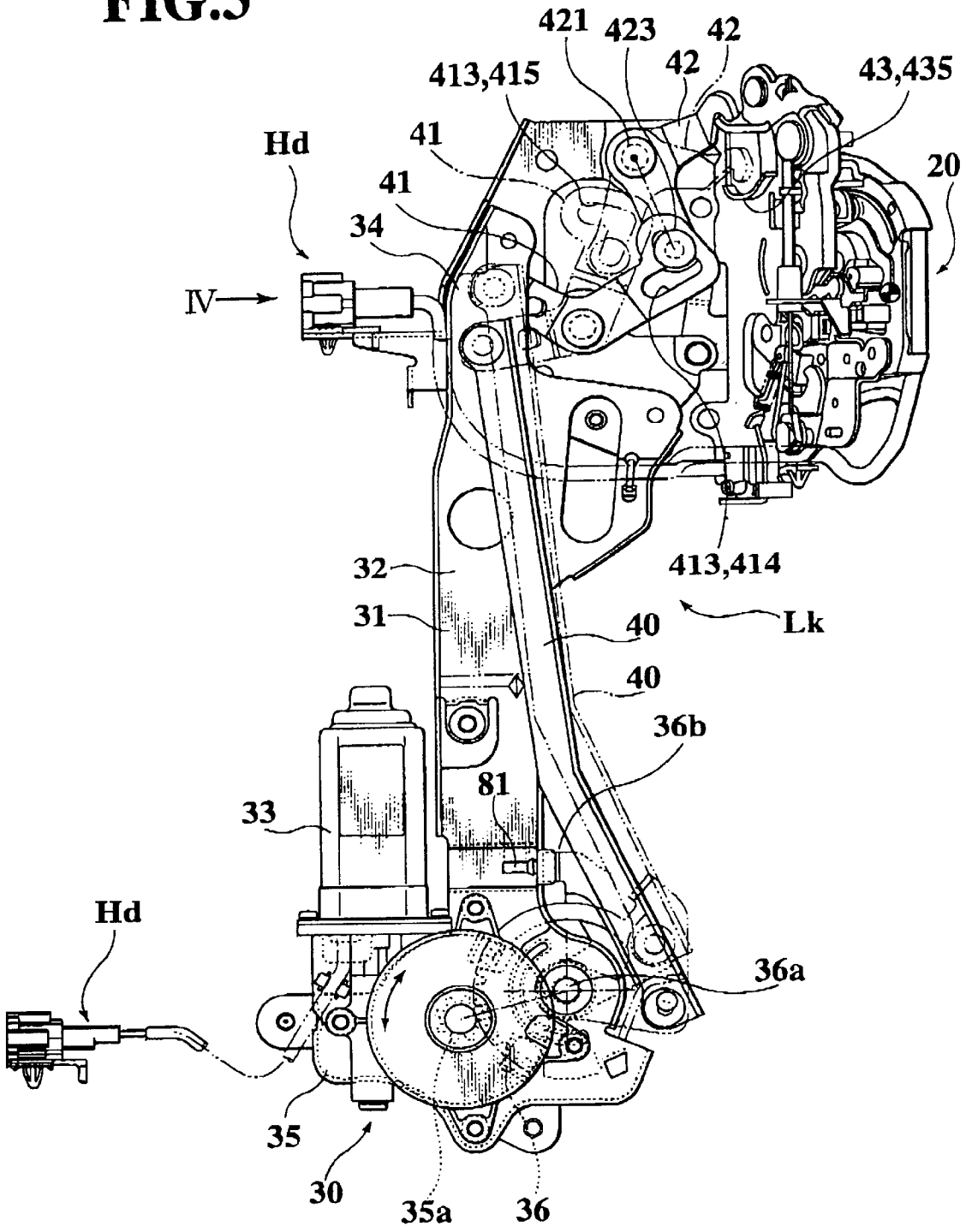
FIG. 3 is a front elevation showing the door closure apparatus and a lock apparatus of FIG. 1.
Figure 4:
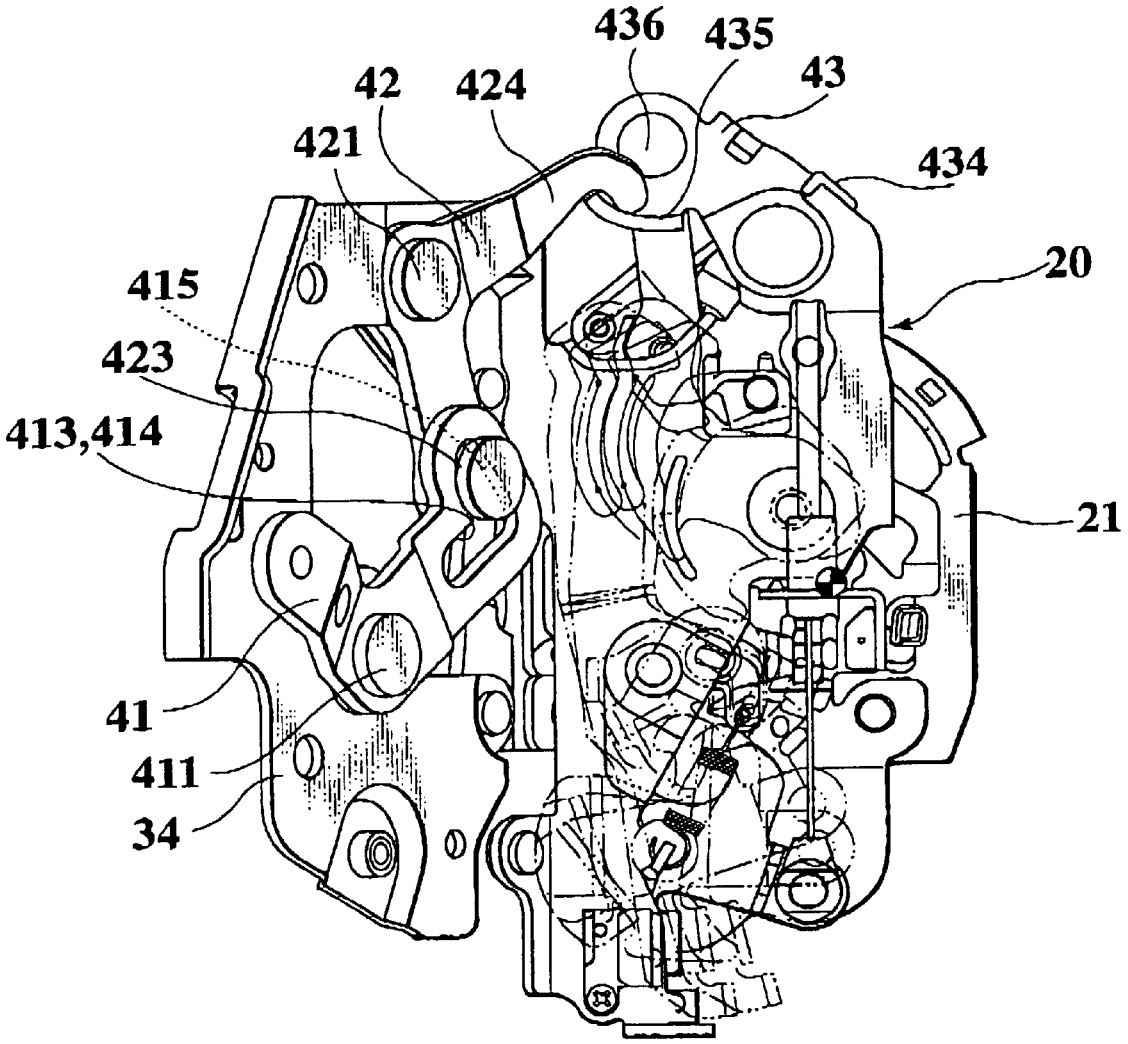
FIG. 4 is an oblique view from the direction indicated as IV in FIG. 3.

As shown in FIG. 2 to FIG. 4, the door 10 has a door frame Fd covered with an inner panel 13 and an outer panel 14 having continuous and integral peripheral and side surfaces. There are arranged in the door 10 a lock apparatus 20, a motor-driven closure 30 as a closer controlled from the controller 70 to drive the lock apparatus 20 via a link motion Lk, and a remote control part 80 that remotely controls the lock apparatus 20 by operation of a pull wire W connected to the remote control part 80 and the lock apparatus 20. Wiring harness Hd is installed for necessary electrical and optical connections. A striker 15 is fixed to a member of a vehicle body frame Fb, that constitutes the rear edge of an opening to be closed with the door 10, The striker 15 corresponds in position to the lock apparatus 20. In vehicle also, necessary wiring harness Hb is installed.

The lock apparatus 20 has a pivot 23 on a base plate 21, which is a main unit constituted chiefly by vertical surfaces, a latch member 22 is pivotally supported by the pivot 23, enabling its rotation to an open position, at which the latch member 22 is completed moved away from the striker 15, a half-latched position, at which there is a small amount of engagement with the striker 15 with the door half closed, and a fully latched position, at which there is full engagement with the striker with the door completely closed.

As shown in FIG. 2 to FIG. 5 and FIG. 9, a latch lever 221 is integrally fixed to the latch member 22, a pressure-receiving moving protrusion 222 being formed thereon. The latch member further has a pawl 223 that restrains the latch member 22 so prevent its rotation at the fully latched position.

Figure 9A:
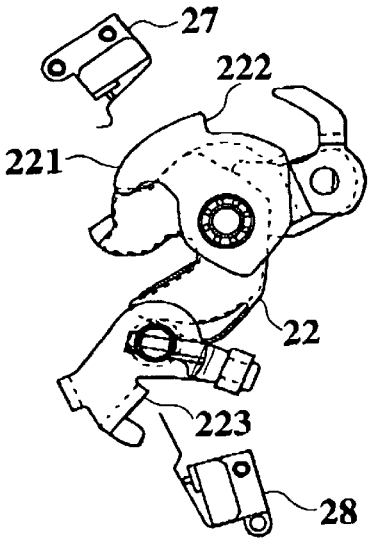
FIGS. 9A–9E illustrate the operating condition of the lock apparatus in the door closure apparatus of FIG. 1.
Figure 9B:
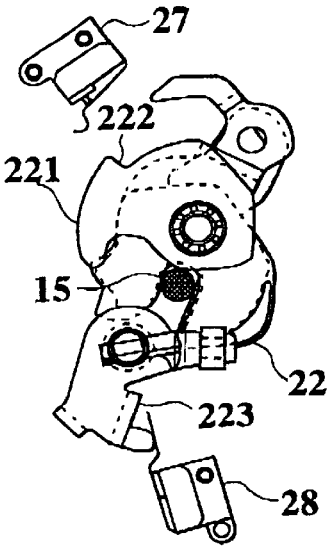
Figure 9C:
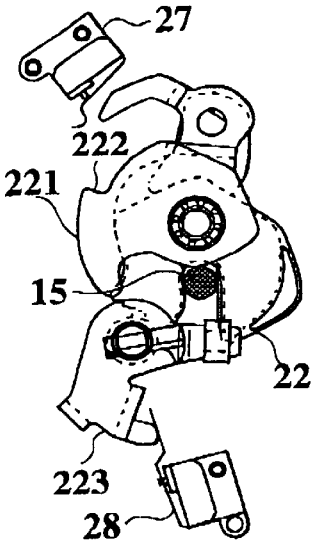
Figure 9D:
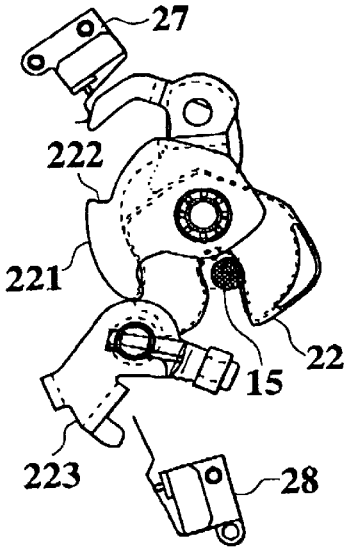
Figure 9E:
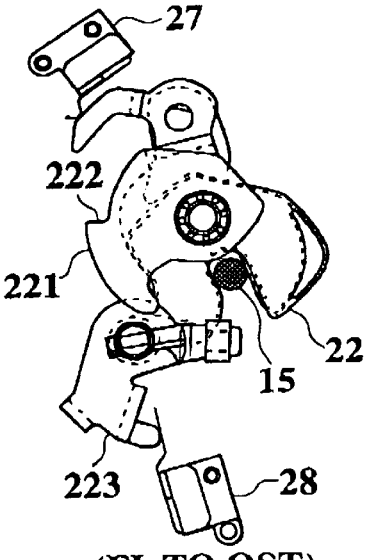

A fully latched switch 27 and a half-latched switch 28 are provided for detection of the operating condition of the lock apparatus 20. That is, in the open condition the half-latched switch 28 and the fully latched switch 27 are in the on condition (FIG. 9A), in the half-latched condition the half-latched switched 28 is on, and the fully latched switch 27 is off (FIG. 9D), and in the fully latched condition to the overstroke (OST) condition the half-latched switch 28 and fully latched switch 27 are both in the off condition (FIG. 9E).

A door-side power supplying connector 16 is mounted to the front wall surface on the peripheral surface of the door 10. A engaging vehicle-side power supplying connector is mounted to the vehicle center pillar, which is the front edge part of the door opening.

A base 31, which is the body of the closure 30, is formed with an extended part 34 for connection to a base plate 21, and a fixing part 32 to be fixed to the door 10. The base plate 21 and the base 31 are integrally provided.

The fully latched switch 27, the half-latched switch 28, a drive motor 33, a handle switch, and other switches are connected to a controller 70 by a wiring harness.

As shown in FIG. 1, the controller 70 has a motor controller 72 which, based on a detection signal such as from the fully latched switch 27 (for example, a fully latched detection signal) and an electrical value detector 75 that serves as a position detector detecting a load current of the drive motor, controls the drive motor 33.

When a waiting position verification mode and a waiting position reset mode are executed, the motor controller 72 of the controller 70 rotates the drive motor 33 in the reverse direction, and when the electrical value detector 75 detects that the load current of the drive motor 33 exceeds a prescribed value, and the detection position detection signal thereof is sent to an input port of the controller, the reverse-direction rotation of the drive motor 33 is slopped, the motor is rotated forward for a prescribed amount of time (T seconds), and the main actuation member 36 is returned to the waiting position.

Figure 12:
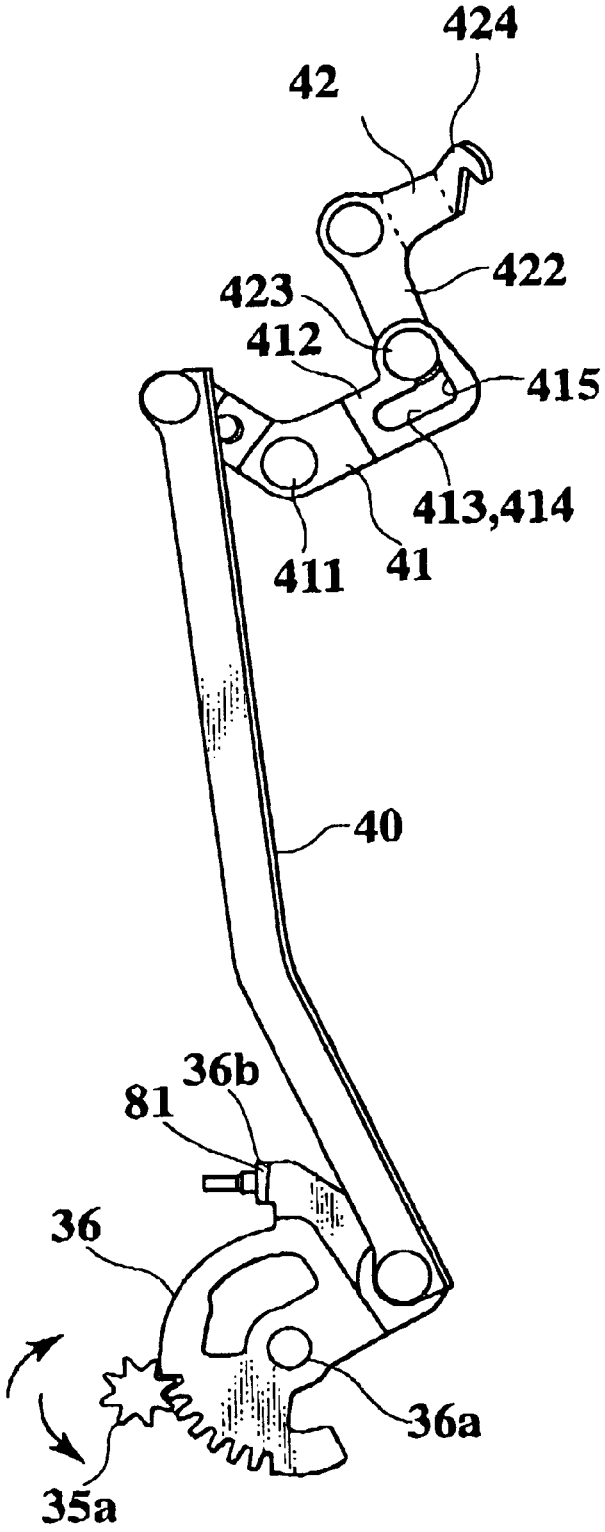
FIG. 12 is a drawing showing the condition of the main actuation member at the detection position in the door closure apparatus of FIG. 1.

As shown in FIG. 3 to FIG. 12, the drive part of the closure 30 is formed by the drive motor 33, a speed reduction mechanism 35, and an output pinion 35*a*. The main actuation member 36 is a sector gear that meshes with the output pinion 35*a*, and the main actuation member 36 is pivotally supported so as to enable it to rotate about a rotating shaft 36*a* to a waiting position (FIG. 10), an actuation position on one side (FIG. 11), with the waiting position therebetween, and a detection position on the other side (FIG. 12). A detection flange 36*b* is formed on a peripheral edge part of the main actuation member 36 substantially opposite the peripheral edge part on which the gear part is formed. A stopper member 81 that comes into contact with the detection flange 36*b* of the main actuation member 36 that has rotated to the detection position is formed at a position of the main actuation member 36 that is opposite the detection flange 36*b*.

The proximal end of a long link 40 is linked to the main actuation member 36. The distal end of the long link 40 extends toward the lock apparatus 20, and links with a first transmission member 41, that is a short link.

The first transmission member 41 is a member with substantially a dog-leg bend as shown as shown in FIG. 3, the center part of which is supported about the pivot shaft 411 so as to permit the first transmission member 41 to swing thereabout. The distal end of the long link 40 is linked to one end of the first transmission member 41, and an engaging groove 413 is formed on a swingable end 412 which is the other end of the first transmission member 41. The engaging groove 413 is formed by the actuation elongate groove 414 extending in the radial direction about the pivoting shaft 411 as a center, and a waiting elongate groove 415 extending in the peripheral direction about the pivoting shaft 411 as a center.

A second transmission member 42 is linked to the swingable end 412 of the first transmission member 41. The second transmission member 42 has the same dog-leg bend, and the center part thereof is supported about the pivot shaft 421 so as to permit the second transmission member 42 to swing thereabout. The a pin member 423 is buried into the swingable end 422 which is one end of the second transmission member 42, this pin member 423 engaging in the engaging groove 413. By the engaging of the pin member 423 with the engaging groove 413, the second transmission member 42 moves in concert with the first transmission member 41.

A spring lever 43 and a closing lever 37 are provided at the other end 424 of the second transmission member 42. The spring lever 43 is pivotally supported so as to be able to swing about the pivoting shaft 431. The spring lever 43 is urged in the clockwise direction by a coil spring 432 shown in FIG. 5. A contact piece 434 makes contact with the contacting flange 433 of the spring lever 43, so as to limit the clockwise swing thereof.

A pressure-receiving moving flange 435 is formed on an end of the spring lever 43. The end of the spring lever 43 is linked to an upper end 371 of the closing lever 37 via a linking shaft 436.

The lower end 372 of the closing lever 37 extends toward the pressure-receiving moving protrusion 222 of the latch lever 221, and pushes in the pressure-receiving moving protrusion 222, thereby forcibly rotating the latch member 22 from the half-latched position to the fully latched position.

The vehicle body-side power-supplying connector 17 and the door-side power-supplying connector 16 are each constituted by a terminal supplying power before the engaging of the latch member 22 and the striker 15, and a terminal that is powered so as to output a signal in the half-latched condition.

Figure 13:
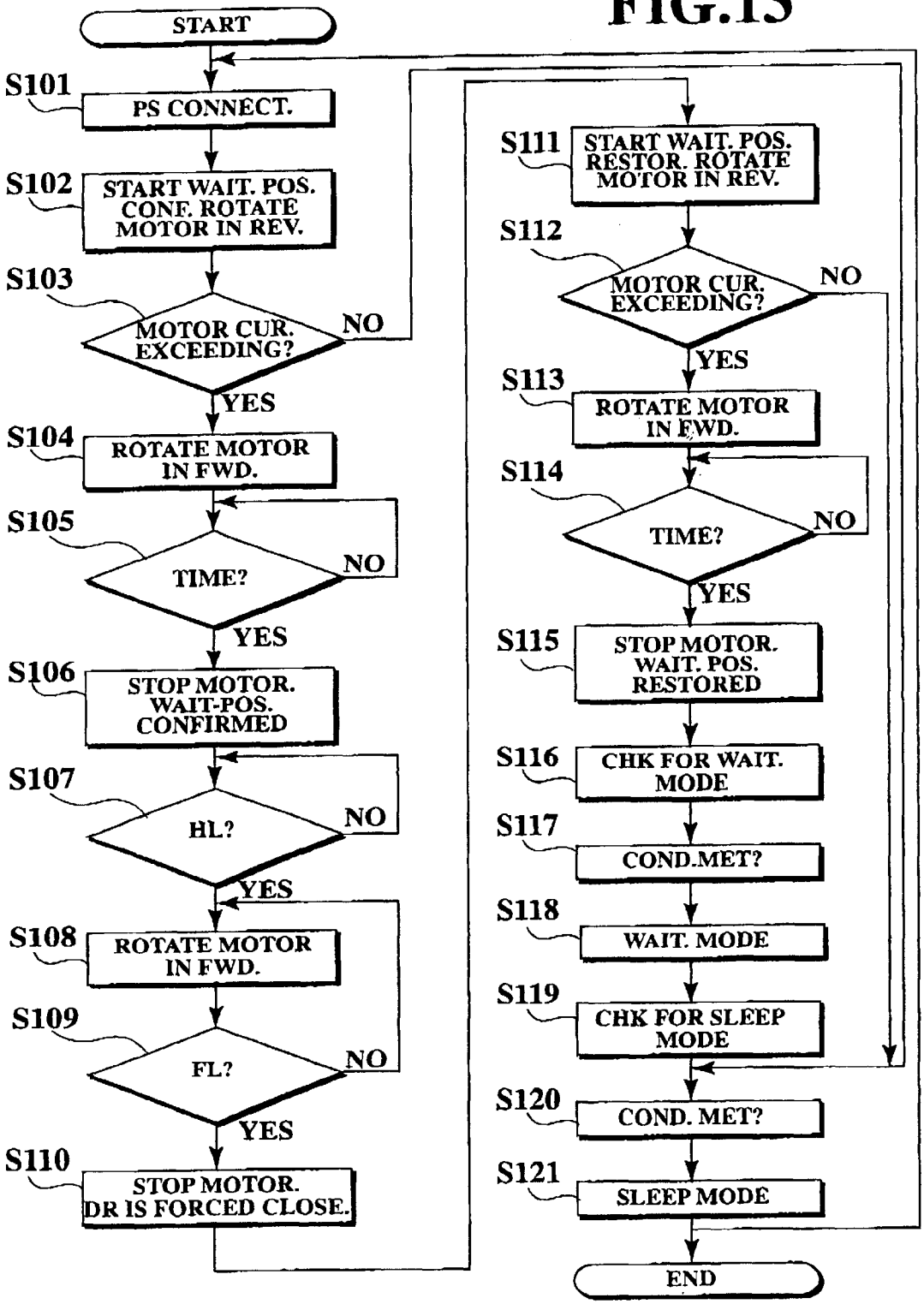
FIG. 13 is a flowchart showing the operation of the door closure apparatus of FIG. 1.

The operation of this door closure apparatus is described below, with reference made to the flowchart of FIG. 13.

When the door 10 is being closed, before the half-latch condition, at a point at which the latch member 22 is only slightly engaged with the striker 15, a terminal of the vehicle body-side power-supplying connector 17 is joined to a terminal of the door-side power-supplying connector 16, a signal is output to the controller 70, the closure 30 is driven (step S101), the position verification mode is started, and the drive motor 33 of the closure 30 rotates in the reverse direction (step S102).

Figure 10:
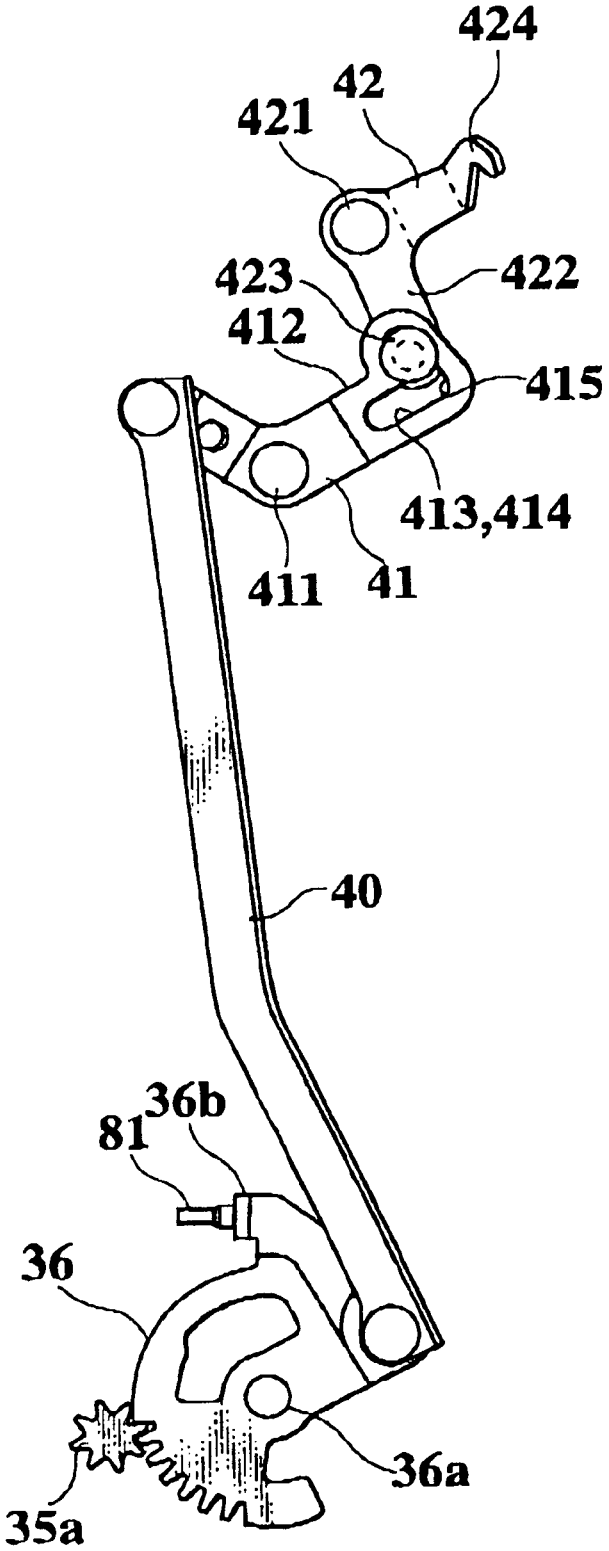
FIG. 10 is a drawing showing the condition of the main actuation member at the waiting position in the door closure apparatus of FIG. 1.
Figure 11:
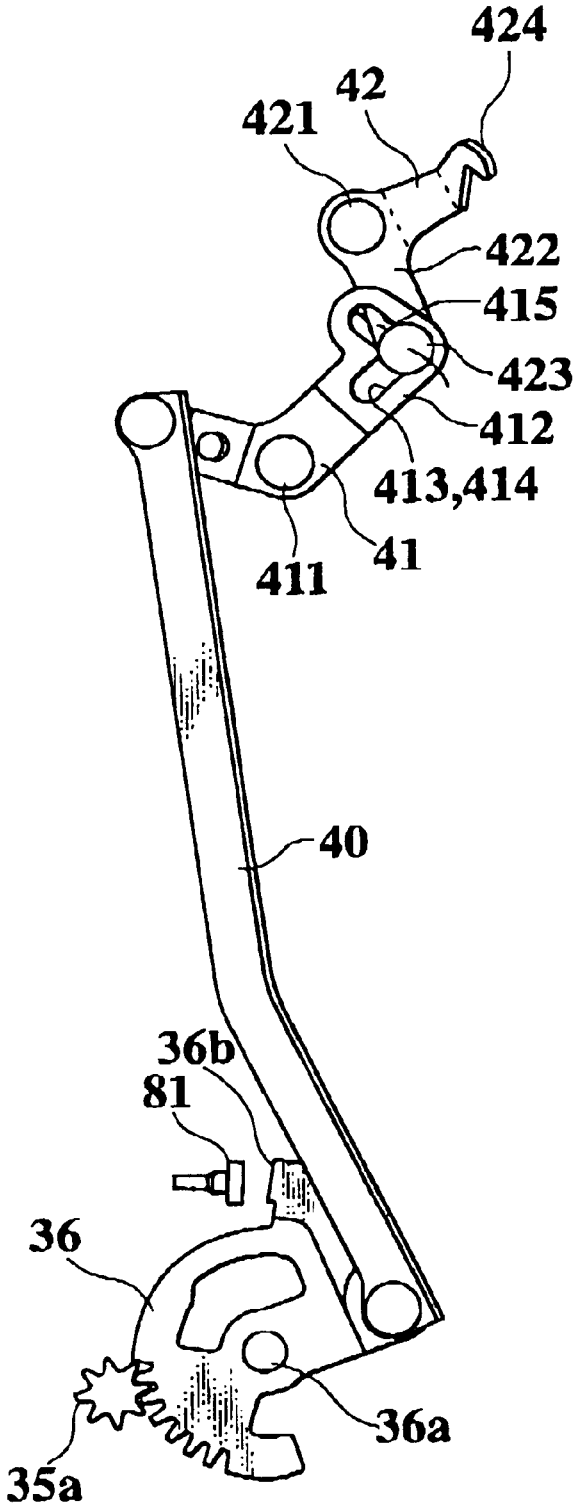
FIG. 11 is a drawing showing the condition of the main actuation member at the initial actuation position in the door closure apparatus of FIG. 1.

When the drive motor 33 rotates for a prescribed amount of time, the main actuation member 36 which is a sector gear rotates in the counterclockwise direction via the output pinion 35*a,* the long link 40 is pushed outward, the first transmission member 41 swings in the clockwise direction in FIG. 10, and if the pin member 423 is in the actuation elongate groove 414 of the first transmission member 41, it moves from the actuator elongate groove 414 to the waiting elongate groove 415, and move relatively within the waiting elongate groove 415. If the pin member 423 is in the waiting elongate groove 415 of the first transmission member 41, it moves relatively therewithin.

At step S102, when the drive motor 33 rotates in reverse for the prescribed amount of time, the motor controller 72 makes a repeated judgment as to whether or not the load current of the drive motor 33 exceeds a prescribed value (step S103). In the normal operating condition, when the drive motor 33 rotates in reverse for the prescribed amount of time, as shown in FIG. 12, the main actuation member 36 rotates to the detection position, and the detection flange 36*b* of the main actuation member 36 comes into contact with the stopper member 81, in which condition the drive motor continues to rotate, so that the detection flange 36*b* and the stopper member 81 push against one another, this causing an excessive load on the drive motor 33, so that the load current (electrical value) of the drive motor 33 becomes large, the load current of the drive motor 33 that exceeds a prescribed value being detected by the electrical value detector 75, a resulting detection signal causing the motor controller 72 to rotate the drive motor 33 in the forward direction (step S104).

In an abnormal condition, if the electrical value detector 75 does not detect a load current of the drive motor 33 as exceeding a prescribed value (no result at step S103), flow proceeds to step S120.

At step S104, when the drive motor 33 is rotated in the forward direction, a judgment is repeatedly made as to whether the prescribed time has already elapsed (step S105). If the prescribed time has elapsed (yes result at step S105), the rotation of the drive motor 33 is stopped, and the waiting position verification mode is ended (step S106). When this occurs, as shown in FIG. 10, the main actuation member 36 is at the waiting position, and the detection flange 36*b* thereof is backed away from the stopper member 81, the detection flange 36*b* of the main actuation member 36 and the stopper member 81 therefore not pressing against one another, so that the load on the drive motor 33 is relieved, the result being that the load current of the drive motor 33 falls within the allowable range.

Next, when the half-latched condition occurs (yes result at step S107), the drive motor 33 rotates in the forward direction (step S108), and the main actuation member 36, which is a sector gear, rotates in the clockwise direction shown in FIG. 10 via the output pinion 35*a,* the long link 40 being pulled in, and the first transmission member 41 swinging in the counterclockwise direction in FIG. 10, the side edge of the actuation elongate groove 414 of the first transmission member 41 pushing in the pin member 423. The result of this is that the second transmission member 42 swings in the clockwise direction shown in FIG. 10, the other end 424 thereof repelling the urging force of the coil spring 432 so as to push in the force-receiving moving flange 435 of the spring lever 43, the spring lever 43 and closing lever 37 being linked by the linking shaft 436, so that the closing lever 37 is pushed.

Figure 5:
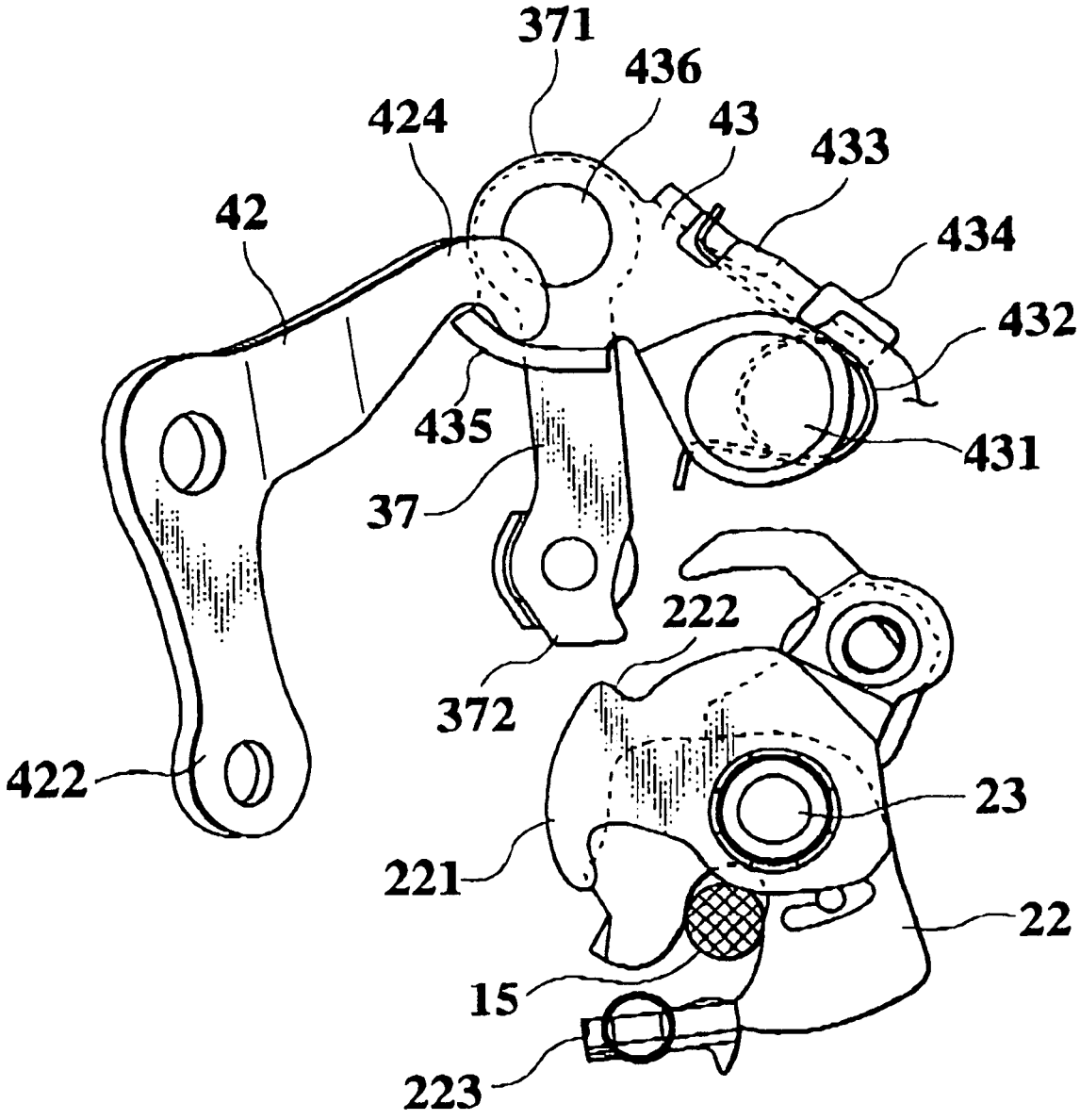
FIG. 5 is a drawing showing the door closure apparatus of FIG. 1, with the lock apparatus in the half-latched condition and the main actuation member at the waiting position.
Figure 6:
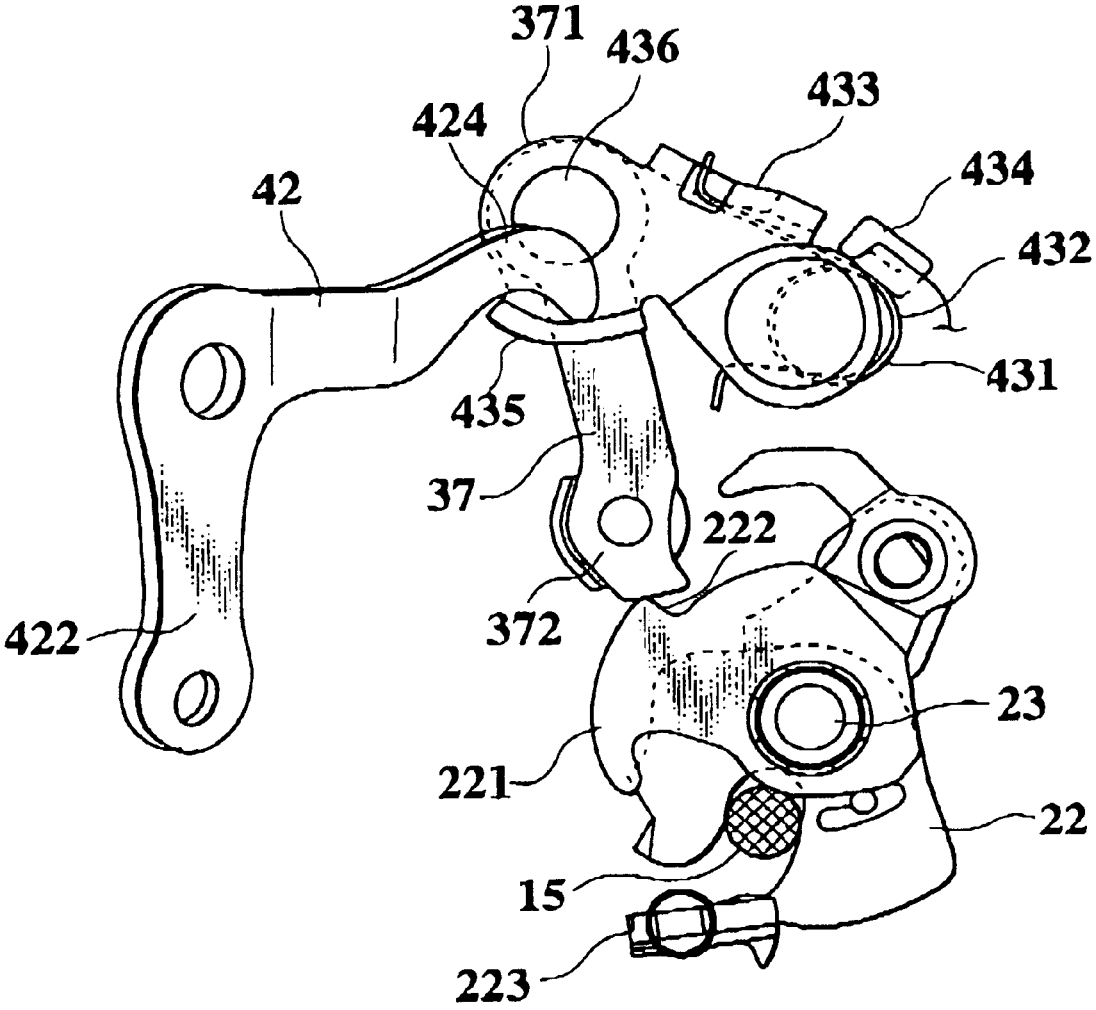
FIG. 6 is a drawing showing the door closure apparatus of FIG. 1, with the lock apparatus in the half-latched condition and the drive motor rotating in the forward direction.
Figure 7:
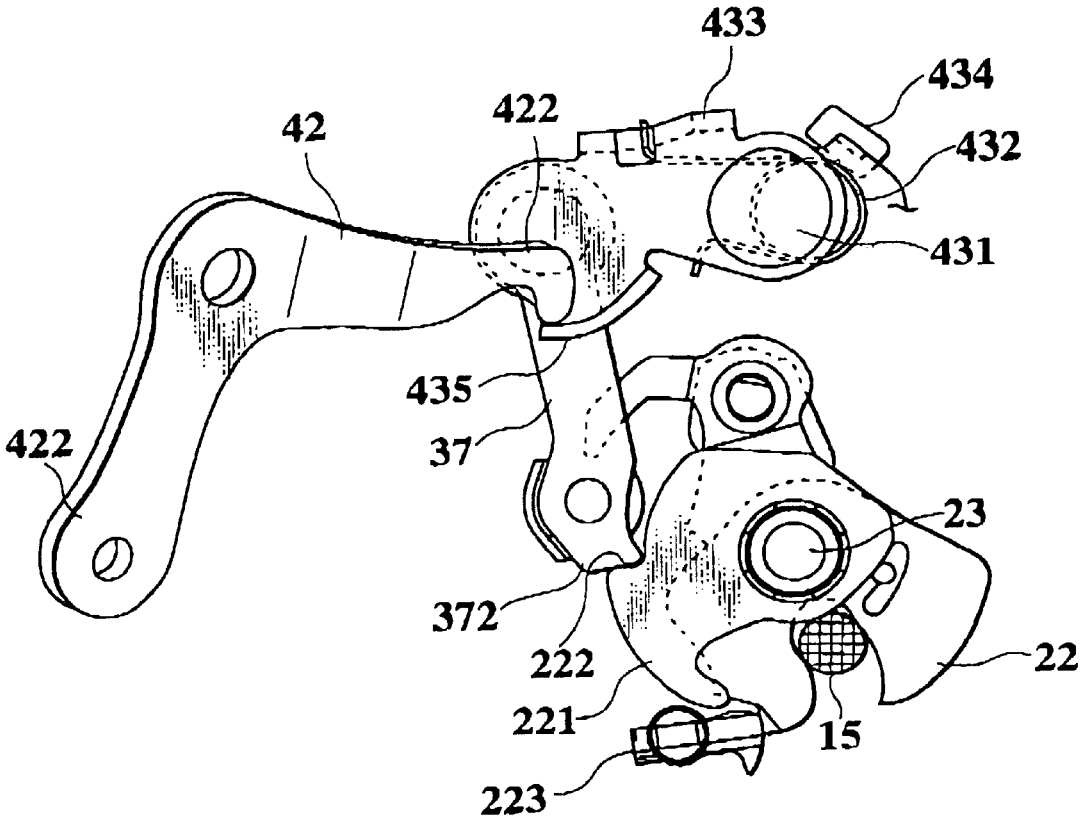
FIG. 7 is a drawing showing the door closure apparatus of FIG. 1, with the lock apparatus in the fully latched condition, and the drive motor starting rotation in the reverse direction.
Figure 8:
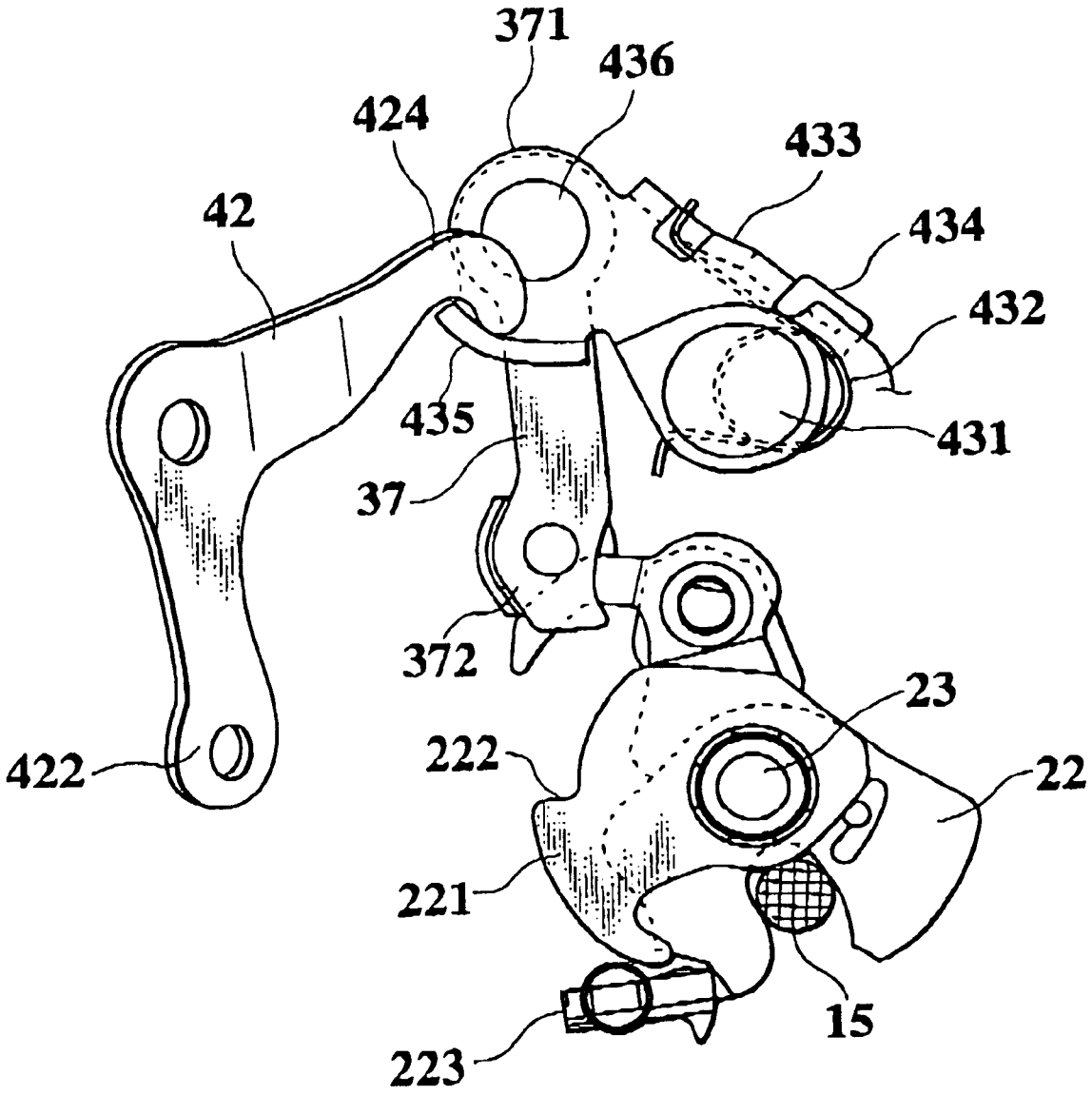
FIG. 8 is a drawing showing the door closure apparatus of FIG. 1, with the lock apparatus in the fully latched condition, and the main actuation member returned to the waiting position.

When the main actuation member 36 rotates from the starting position of the actuation position (FIG. 11) toward the ending position of the actuation position, the closing lever 37 is pushed further so that, as shown in FIG. 5 and FIG. 6, the lower end 372 of the closing lever 37 pushes the force-receiving moving protrusion 222 of the latch lever 221, thereby rotating the latch member 22 counterclockwise as shown in FIG. 6, and when it is rotated from the half-latched position shown in FIG. 6 to the fully latched position shown in FIG. 7, the pawl 223 engages with the latch member 22, so that the latch member 22 is restrained at the fully latched position, unable to rotate. Before and after this action, when the fully latched switch 27 operates and the fully latched condition occurs (yes result in step S109), the door 10 goes into the completed closed condition, the drive motor 33 stops rotating, thereby ending the forcible closing (step S110).

After the above, the waiting position reset mode starts, and the drive motor 33 rotates in the reverse direction (step S111). By doing this, the main actuation member 36 rotates from the actuation position ending position, through the actuation position starting position shown in FIG. 11 and the waiting position, the drive motor 33 rotating in reverse for a prescribed amount of lime, whereupon the motor controller 72 performs a repeated judgment as to whether or not the load current of the drive motor 33 exceeds a prescribed value (step S112).

In the normal operating condition, when the drive motor 33 rotates in reverse for the prescribed amount of time, the main actuation member 36 rotates to the detection position, and the detection flange 36*b* of the main actuation member 36 comes into contact with the stopper member 81, in which condition the drive motor continues to rotate, so that the detection flange 36*b* and the stopper member 81 continue to push against one another, this causing an excessive load on the drive motor 33, so that the load current (electrical value) of the drive motor 33 becomes large, the load current of the drive motor 33 that exceeds a prescribed value being detected by the electrical value detector 75, a resulting detection signal causing the motor controller 72 to rotate the drive motor 33 in the forward direction (step S113).

In an abnormal condition, if the electrical value detector 75 does not detect a load current of the drive motor 33 as exceeding a prescribed value (no result at step S112), flow proceeds to step S120.

At step S113, when the drive motor 33 is rotated in the forward direction, a judgment is repeatedly made as to whether the prescribed time (T seconds) has already elapsed (step S114). If the prescribed time has elapsed (yes result at step S114), the rotation of the drive motor 33 is stopped, and the waiting position reset mode is ended (step S115). When this occurs, the main actuation member 36 is at the waiting position, and the detection flange 36*b* thereof is backed away from the stopper member 81, the detection flange 36*b* of the main actuation member 36 and the stopper member 81 therefore not pressing against one another, so that the load on the drive motor 33 is relieved, the result being that the load current of the drive motor 33 falls within the allowable range.

When the main actuation member 36 is at the waiting position, the pin member 423 is inside the waiting elongate groove 415 and sandwiched between both side edge parts thereof, the second transmission member 42 being unable to swing alone, thereby preventing rattling of the second transmission member 42 caused by vibration during operation of the vehicle.

After the waiting position reset mode ends, a 5-second waiting mode, for example, begins, during which the status of switches is verified (step S116). When the conditions necessary to end the waiting mode have been satisfied, the waiting mode is ended (step S118). Next, the sleep mode is started, in which a power savings is achieved (step S119). When the conditions necessary to end the sleep mode have been satisfied (step S120), the sleep mode is ended (step S121).

By closing the door 10 with a strong force, the latch member 22 is completely engaged with the striker 15, so that the pawl 223 is held by the latch member 22, thereby restraining the latch member 22 at the fully latched position, unable to rotate, which places the door 10 in the completely closed condition.

Although the foregoing embodiment was described for the example in which the drive motor 33 is rotated in the forward direction for a prescribed amount of time (T seconds), the main actuation member 36 being returned from the detection position to the waiting position, it will be understood that it is alternately possible to rotate the drive motor 33 in the forward direction and, when a drop in the load current of the drive motor 33 is detected by the electrical value detector 75, to stop the rotation of the drive motor 33. In this case, the electrical value when the load current of the motor 33 is excessive is taken as a high reference value, and the electrical value when the load current of the drive motor 33 is within an allowable range is taken as the low reference value. When the electrical value detector 75 detects the high reference value, this condition is taken to mean that the main actuation member 36 is at the detection position, and when the electrical value detector 75 detects the low reference value, this condition is taken to mean that the main actuation member 36 is at the waiting position.

Figure 14:
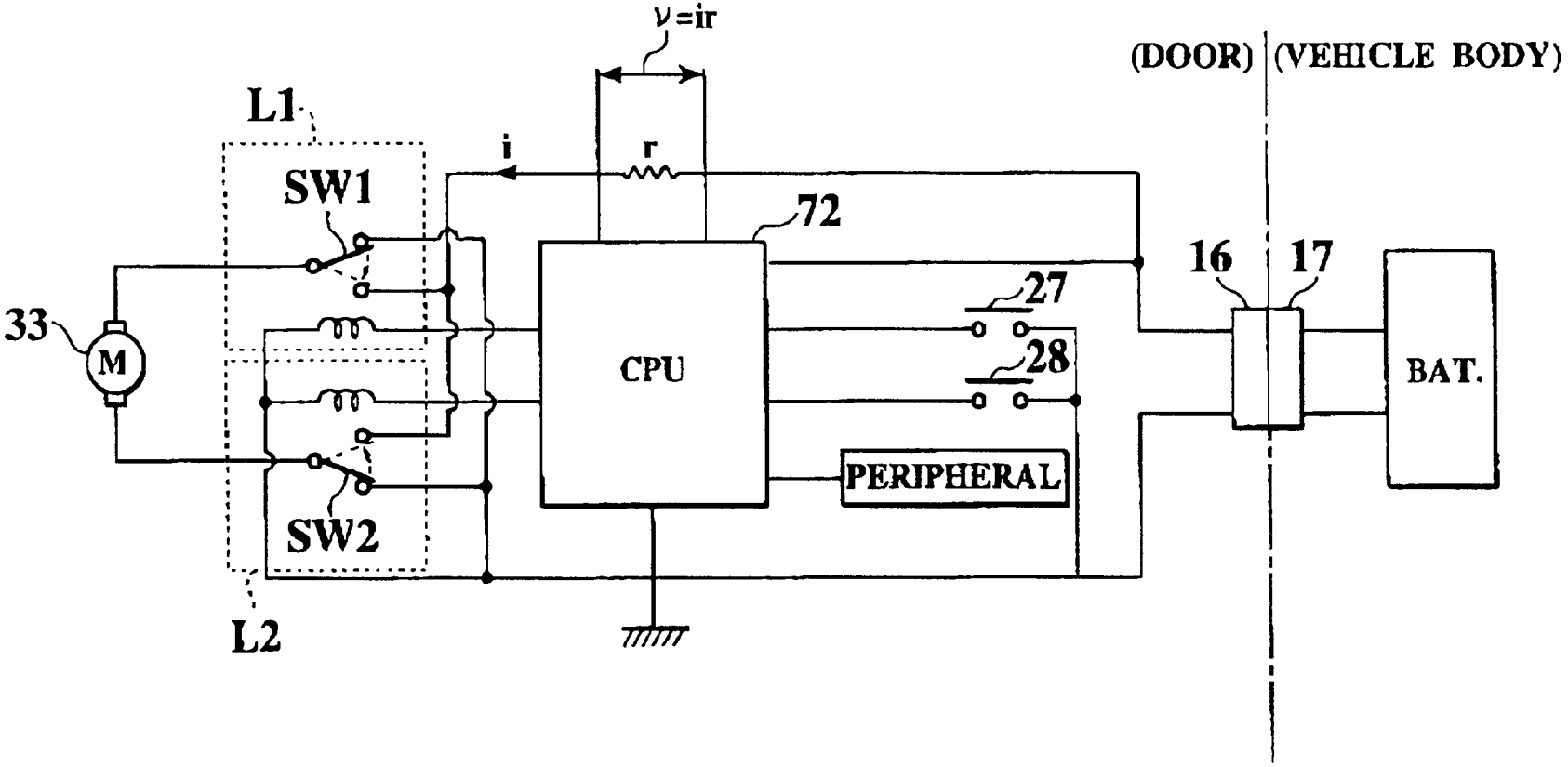
FIG. 14 is a circuit diagram of the door closure apparatus of FIG. 1.

As shown in FIG. 14, when the connectors 16, 17 are mated to each other, the drive motor 33 is connected at a positive electrode thereof via a relay L1 and a small resistor r to a vehicle-mounted battery, and at a negative electrode thereof via another relay L2 to a grounded node. As a motor current i is conducted, the resistor r has a voltage drop v=ir as an electrical value input to the CPU, where digital data on its magnitude is processed in consideration of actions of the limits switches 27, 28 and data from the peripherals to provide a pair of current control signals to electromagnetic switches SW1, SW2 in the relays L1, L2, so that the motor 33 is driven forward or in reverse, as necessary. Note that the motor 33 is not a servo or step motor, but a simple direct-current motor.

According to an embodiment of the present invention, after completing closing the door or after the start of drive of the closure apparatus the drive motor is rotated, for example, in the reverse direction, when the movement of the main actuation member to the detection position is detected by a change in an electrical value of the drive motor, the drive motor is caused to rotate in the forward direction, for example, so that the main actuation member is returned to the waiting position, the result being that, at the waiting position the main actuation member is backed away from the stopper member, so that the main actuation member an the stopper member are not pressing up against one another, thereby relieving the excessive load placed on the drive motor when the main actuation member and the stopper member are pressing against one another, and improving the lifespan of the main actuation member, the stopper member, and the driving motor.

According to another embodiment of the present invention when the main actuation member is at the waiting position, the pin member is caused to engage the waiting elongate groove, thereby preventing rattling of the first transmission member and second transmission member during operation of the vehicle.

As will be seen from the foregoing description, according to species of the present invention, a main actuation member is allowed in a waiting position to be free from stopping in a condition pressing a stopper member, thus having a moderate load imposed on a drive motor, allowing for improvements in durability of the main actuation member, stopper member and drive motor.

An aspect of the species of the present invention to achieve this effect is a closure apparatus for a vehicle door including a striker (15) disposed on one of a periphery of a door (10) and a periphery of an opening to be closed with the door (10), and a lock apparatus (20) disposed on the other of the periphery of the door and the periphery of the opening, wherein a driven member (22) of one of the striker (15) and the lock apparatus (20) is forcibly operated with a motive force of a drive motor (33) to bring the door (10) from an incomplete door-close condition to a complete door-close condition, wherein the closure apparatus comprises a main actuation member (36), a stopper member (81), a position detector, and a controller (70), wherein the main actuation member (36) is movable, relative to a waiting position for the main actuation member (36) to wait for operation of the driven member (22), on one side to an actuation position for the main actuation member (36) to actuate the driven member (22) and on another side to a detection position for the main actuation member (36) to be detected, with the waiting position therebetween, the stopper member (36) is configured to limit movement of the main actuation member (36) toward the other side, when the main actuation member (36) is moved to the detection position by rotation of the drive motor (33) in one of forward and reverse directions and brought into contact with the stopper member (81), the position detector comprises an electrical value detector (75) configured to detect movement of the main actuation member (36) to the detection position in dependence on a change in an electrical value of the drive motor (33) at a time when the main actuation member (36) comes into contact with the stopper member (81), 7 and the controller comprises a motor controller (72) configured to effect a rotation of the drive motor (33) in the other of the forward and reverse directions when the main actuation member (36) is moved to the detection position, and to stop the rotation of the drive motor (33) when the electrical value of the drive motor (33) has a value within an allowable range or when a prescribed amount of time has elapsed, to return the main actuation member (36) from the detection position to the waiting position.

According to another aspect of the species of the present invention, the controller (70) has the motor controller (72) configured to rotate the drive motor (33) in one of the forward and reverse directions to move the main actuation member (36) to the detection position when the door (10) is in the complete door-close condition.

According to another species of the present invention, the controller (70) has the motor controller (72) configured to rotate the drive motor (33) in one of the forward and reverse directions to move the main actuation member (36) to the detection position upon start of actuation of the door closure apparatus.

According to another aspect of the species of the present invention, the closure apparatus further comprises a motive force transmitter (41, 42) comprised of a first transmission member (41) provided on an end at the main actuation member (36) of a transmission path for transmission of a motive force, and a second transmission member (42) provided on an end at the driven member (22) of the transmission path, the first transmission member (41) having, at a swingable end (412) thereof swingable with the motive force transmitted, one of an engagement groove (413) and a pin member (423) engageable with the engagement groove (413), the second transmission member (42) having, at a swingable end (412) thereof swingable with the motive force transmitted, the other of the engagement groove (413) and the pin member (423) engageable with the engagement groove (413), the engagement groove (413) comprising an actuation-oriented elongate groove (414) substantially radially extending about a swing center of the first transmission member (41) for relative movement of the pin member (423) to render the second transmission member (42) swingable when the first transmission member (41) is swung with the main actuation member (36) moved to the actuation position, and a waiting-oriented elongate groove (415) substantially circumferentially extending about the swing center of the first transmission member (41) for relative movement of the pin member (423) to render the second transmission member (42) unswingable when the first transmission member (41) is swung with the main actuation member (36) moved to the waiting position.

Operations of the species according to the aspect described will be described below.

When movement of the main actuation member (36) to the detection position is detected by a change in an electrical value of the drive motor (33), the drive motor (33) is caused to rotate in either the forward or reverse direction, thereby returning the main actuation member (36) to the waiting position.

To return the main actuation member (36) from the actuation position to the waiting position, for example, the drive motor (33) is caused to rotate, for example, in the reverse direction, causing the main actuation member (36) to move to the other side. As a result, the main actuation member (36) passes by the waiting position and moves to the detection position.

When the main actuation member (36) moves to the detection position, the stopper member (81) comes into contact with the main actuation member (36), and the load on the drive motor (33), which continues to rotate, becomes excessive, this being reflected in a change in an electrical value. Upon detection of a change in the electrical value, the motor controller (72) of the controller (70) causes the drive motor (33) to rotate in a forward direction, for example. Thereby, the main actuation member (36) is distanced from the stopper member (81), i.e., the moved from the detection position to the waiting position, and for example if the drive motor (33) is stopped after a lapse of a prescribed time with a forward rotation, the main actuation member (36) is moved to the waiting position, to stop there.

When the change in the electrical value (for example, the load current) comes within an allowable range, the forward rotation of the drive motor (33) can be stopped. Or when the rotational speed of the drive motor (33) comes within an allowable range, the forward rotation of the drive motor (33) can be stopped.

When the main actuation member (36) is at the waiting position, the main actuation member (36) is distanced from the stopper member (81) and the main actuation member (36) and the stopper member (81) are not pushing up against one another, so that the load on the drive motor (33) that had an excessive current when the stopper member (81) and the main actuation member (36) were in contact is relieved.

The result of the above is an improvement in the life span of the main actuation member (36), the stopper member (81), and the drive motor (33). There is no need to provide a switch for the purpose of detecting that the main actuation member (36) is at the waiting position, thereby reducing the number of parts and enabling a reduction in size of the apparatus.

According to another species of the invention, after the drive motor (33) rotates, for example, in the forward direction and the door (10) is brought from the half-latched condition to the fully latched condition, the drive motor (33) is caused to rotate in the reverse direction, thereby moving the main actuation member (36) to the detection position side.

When the main actuation member (36) has moved to the detection position, based on a change in an electrical value accompanying an excessive load place on the drive motor (33), the drive motor (33) is rotated in the forward direction, for example for a prescribed amount of time, thereby moving the main actuation member (36) to the waiting position as noted above.

That is, after moving the main actuation member (36) to the actuation position, and bring the door (10) from the half-latched condition to the fully latched condition, the main actuation member (36) is first moved to the detection position, after which it can be reliably moved to the waiting position.

According to another species of the invention, when the drive of the door closure apparatus starts, the drive motor (33) is rotated, for example, in the reverse direction, and the main actuation member (36) is moved to the detection position side.

That is, regardless of the position of the main actuation member (36), when the drive of the closure apparatus starts, the drive motor is rotated in the reverse direction, so as to first move the main actuation member (36) to the detection position, after which the drive motor (33) is rotated in the forward direction, for example for prescribed amount of time, enabling reliable return to the waiting position.

According to another species of the invention, when the main actuation member (36) is at the waiting position, because the pin member (423) is engaged in the elongate groove (415) for the waiting condition, the second transmission member (42) is restrained, preventing its swing alone.

That is, when the main actuation member (36) moves to the actuation position and the first transmission member (41) swings, the pin member (423) moves relatively within the actuation-oriented elongate groove (414) of the engagement groove (413). Because the elongate groove (414) for actuation extends substantially in a radial direction about the center of swing of the first transmission member (41), the pin member (423) and the elongate groove (414) for actuation press up against one another, thereby preventing swing of the second transmission member (42).

When the main actuation member (36) moves to the waiting position and the first transmission member (41) swings, the pin member (423) moves relatively within the waiting-oriented elongate groove (415) of the engagement groove (413). Because the elongate groove (415) for waiting extends substantially in a circumfernetial direction with respect to the center of swing of the first transmission member (41), the pin member (423) and the elongate groove (415) for waiting do not push against one another, and the second transmission member (42) does not swing.

When the main actuation member (36) moves to the waiting position, the first transmission member (41) is linked to the main actuation member (36), so that it cannot swing alone. On the other hand, with the pin member (423) in contact with both edges of the waiting-oriented elongate groove (415), the second transmission member (42) is restrained, so that it cannot swing alone. The result of this is that the first transmission member (41) and the second transmission member (42) do not rattle because of, for example, vibrations during operation of the vehicle.

The above describes embodiments of the present invention with reference to relevant accompanying drawings. It will be understood, however, that the actual configuration of the present invention is nor limited to that described, and is amenable to various changes, within the spirit or scope of the following claims.

What is claimed is:

1. A closure apparatus for a vehicle door including a striker disposed on one of a periphery of a door and a periphery of an opening to be closed with the door, and a lock apparatus disposed on the other of the periphery of the door and the periphery of the opening, wherein a driven member of one of the striker and the lock apparatus is forcibly operated with a motive force of a drive motor to bring the door from an incomplete door-close condition to a complete door-close condition, wherein the closure apparatus comprises a main actuation member, a stopper member, a position detector, and a controller, wherein the main actuation member is movable, relative to a waiting position for the main actuation member to wait for operation of the driven member, on one side to an actuation position for the main actuation member to actuate the driven member and on another side to a detection position for the main actuation member to be detected, with the waiting position therebetween, the stopper member is configured to limit movement of the main actuation member toward the other side, when the main actuation member is moved to the detection position by rotation of the drive motor in one of forward and reverse directions and brought into contact with the stopper member, the position detector comprises an electrical value detector configured to detect movement of the main actuation member to the detection position in dependence on a change in an electrical value of the drive motor at a time when the main actuation member comes into contact with the stopper member, and the controller comprises a motor controller configured to effect a rotation of the drive motor in the other of the forward and reverse directions when the main actuation member is moved to the detection position, and to stop the rotation of the drive motor when the electrical value of the drive motor has a value within an allowable range or when a prescribed amount of Time has elapsed, to return the main actuation member from the detection position to the waiting position.

2. A closure apparatus according to claim 1, wherein the controller has the motor controller configured to rotate the drive motor in one of the forward and reverse directions to move the main actuation member to the detection position when the door is in the complete door-close condition.

3. A closure apparatus according to claim 1, wherein the controller has the motor controller configured to rotate the drive motor in one of the forward and reverse directions to move the main actuation member to the detection position upon start of actuation of the door closure apparatus.

4. A closure apparatus according to claim 1, further comprising a motive force transmitter comprised of:

a first transmission member provided on an end at the main actuation member of a transmission path for transmission of a motive force; and a second transmission member provided on an end at the driven member of the transmission path, wherein the first transmission member has, at a swingable end thereof swingable with the motive force transmitted, one of an engagement groove and a pin member engageable with the engagement groove, the second transmission member has, at a swingable end thereof swingable with the motive force transmitted, the other of the engagement groove and the pin member engageable with the engagement groove, and the engagement groove comprises:

an actuation-oriented elongate groove substantially radially extending about a swing center of the first transmission member for relative movement of the pin member to render the second transmission member swingable when the first transmission member is swung with the main actuation member moved to the actuation position; and a waiting-oriented elongate groove substantially circumferentially extending about the swing center of the first transmission member for relative movement of the pin member to render the second transmission member unswingable when the first transmission member is swung with the main actuation member moved to the waiting position.

* * * * *